US005416685A

United States Patent [19]

Myers

[11] Patent Number: 5,416,685

[45] Date of Patent: May 16, 1995

[54] MAGNETIC UTILITY LAMP

[76] Inventor: James R. Myers, 63 Depot St., Colchester, Vt. 05446

[21] Appl. No.: 296,657

[22] Filed: Aug. 26, 1994

[51] Int. Cl.[6] ..... F21V 21/08

[52] U.S. Cl. ..... 362/398; 362/260; 362/277; 362/301; 362/396; 362/399

[58] Field of Search ..... 362/297, 346, 301, 399, 362/398, 396, 260, 277, 319

[56] References Cited

U.S. PATENT DOCUMENTS

| | | | |
|---|---|---|---|
| D. 308,263 | 5/1990 | Cook | D26/140 |
| 1,295,333 | 2/1919 | Kramer | 362/398 |
| 1,932,143 | 10/1933 | Piercy | 240/52.1 |
| 2,460,173 | 1/1949 | Halbing | 240/54 |
| 2,506,400 | 5/1950 | Wietz | 248/206 |
| 2,987,612 | 6/1961 | Haulter | 240/52.15 |
| 4,019,047 | 4/1977 | Frey | 240/54 A |
| 4,258,414 | 3/1981 | Sokol | 362/421 |
| 4,321,660 | 3/1982 | Sokol | 362/398 X |
| 4,369,487 | 1/1983 | Carlow | 362/258 |
| 4,564,894 | 1/1986 | Gonzalez | 362/398 |
| 4,672,515 | 6/1987 | Baker | 362/398 |
| 4,727,462 | 2/1988 | Komonko | 362/398 |
| 5,140,508 | 8/1992 | Komonko | 362/396 |
| 5,178,453 | 1/1993 | Runels | 362/398 |
| 5,213,412 | 5/1993 | Ciallella | 362/398 |
| 5,309,336 | 5/1994 | Hartt et al. | 362/183 |

FOREIGN PATENT DOCUMENTS 640019 7/1950 United Kingdom .

*Primary Examiner*—Stephen F. Husar
*Attorney, Agent, or Firm*—Theodore R. Touw

[57] ABSTRACT

A magnetic utility lamp has a housing that is polyhedral or prismatic in shape (having a member of flat faces), a handle, and a hook, all of which are magnetized. The magnetization of the combined housing, handle and hook is preferably done in such a way as to make one common magnetic polarity extending along the major axis of the lamp. In another embodiment, an even number of magnetic polarities may be made, alternating in the senses of their magnetic poles. The combination of polyhedral shape and magnetization provides versatile positioning of the lamp. Within the magnetic housing is a unique polyhedral reflector, which is easily re-oriented by the user to direct light from the lamp bulb in a desired direction. The interior surface of the utility lamp housing is adapted to hold the polyhedral reflector adjustably in a number of discrete aiming directions. The magnetic lamp design is adaptable to accommodate standard household lamp bulbs, fluorescent bulbs, and (with a suitable transformer) high-intensity bulbs. An auxiliary mounting plate of ferromagnetic or high-magnetic-permeability material may be provided, removably attached to the utility lamp housing. The removable auxiliary mounting plate is shaped to fit the polyhedral exterior shape of the utility lamp housing, preferably matching the shape of two or more adjacent flat faces of the housing. The auxiliary mounting plate is equipped with straps for attachment to non-magnetic supports.

47 Claims, 7 Drawing Sheets

MAGNETIC UTILITY LAMP

FIELD OF THE INVENTION

The invention relates to utility and trouble lamps, especially lamps to be used in proximity to ferromagnetic materials such as steel automotive bodies and frames. It relates more particularly to utility lamps having a magnetic handle and a magnetic housing with a multiplicity of permanently magnetized planar surfaces in a polyhedral shape for attachment to a variety of external ferrous-metal or magnetizable objects. It also relates to utility lamps having a polyhedral reflector and bulb-mount capable of being easily re-oriented to various orientations within the housing to optimize the direction of illumination.

BACKGROUND OF THE INVENTION

While utility lamps or so-called "trouble lights" are in widespread use, there are still some persistent problems with such lamps which have not had entirely satisfactory solutions. The great majority of utility lamps have hooks by which they may be hung while in use, but many situations occur in which there is no suitable support in the use environment for supporting a hook of the size provided, or for supporting any hook. If the use environment does include a suitable support for hanging the utility lamp by a hook, that support is often not close enough to the work region in need of illumination. Once a utility lamp is hung by an integral hook, its orientation is more or less fixed by the orientation of its support, and that orientation may not be the best for illuminating the desired work region. These problems often occur during maintenance or repair of automobiles and industrial equipment. Thus a need exists for a utility lamp that has improved versatility both with respect to its support in the use environment and with respect to orientation of the illumination it provides.

DESCRIPTION OF THE RELATED ART

Many utility lamps provided with a magnet for supporting the lamp are known in the art. Piercy U.S. Pat. No. 1,932,143 has a permanent magnet secured to a socket of a portable lamp. Halbing U.S. Pat. No. 2,460,173 shows a square lamp guard with a permanent magnet attached. Wietz U.S. Pat. No. 2,506,400 has a magnetic support, which is shown attached to wires of a portable lamp cage. U.K. Patent No. 640,019 (Kristiansen) has a permanent magnet placed in a holder device which is cast or pressed into the body of a lamp. Haulter U.S. Pat. No. 2,987,612 shows a magnet mounted on a portable extension light bulb cage. Frey U.S. Pat. No. 4,019,047 shows a magnet attached to a rotatable ring on a protective cage of a trouble lamp. Sokol U.S. Pat. Nos. 4,258,414 and 4,321,660 have a magnet at one end of a trouble-light handle. Carlow U.S. Pat. No. 4,369,487 has a magnet attached to a cord storage section of a utility lamp. Gonzalez U.S. Pat. No. 4,564,894 shows magnets of soft iron with pole pieces, attached on the outside of a shield. Baker U.S. Pat. No. 4,672,515 has a magnet attached to a clamp that is releasably attached to a track on a utility light. Komonko U.S. Pat. Nos. 4,727,462 and 5,140,508 show clamp-on magnets for trouble lamps. Runels U.S. Pat. No. 5,178,453 has a portable assembly with base and cover (both of which may have magnetic surfaces) for mounting portable articles from a flexible panel such as fabric of a tent. Ciallella U.S. Pat. No. 5,213,412 shows a magnet in a lift plate attached to a drop light. Hartt et al. U.S. Pat. No. 5,309,336 shows a flashlight connecting to an automotive cigarette lighter, with a magnetic foot attached to the flashlight body. Cook U.S. Pat. No. DE 308,263 shows an ornamental design for a magnetic trouble lamp holder.

PROBLEMS SOLVED BY THE INVENTION

This invention solves two problems encountered in use of conventional utility lamps, viz. support of the utility lamp close to a work region, and orientation of the light toward a specific work area, for those common use situations in which ferrous metal or paramagnetic supports are available, but in which supports for a hook are absent or inadequate. It solves these problems without diminishing the utility of conventional use, as in supporting the utility lamp by an integral hook. The invention is manufactured by low-cost processes.

OBJECTS AND ADVANTAGES OF THE INVENTION

One object of the invention is an improved utility or trouble lamp for use in work environments near ferrous-metal or paramagnetic objects, where no adequate or suitable supports for hook attachment are available. Another object is a utility or trouble lamp having improved versatility with respect to its support in the environment. Another object is a utility or trouble lamp with integral magnetism, not requiring separate attached magnets. Another object is a utility or trouble lamp of reduced weight compared to lamps with attached soft iron magnets. Another object is a magnetic utility or trouble lamp with improved distribution of weight compared with magnetic lamps having attached discrete magnets. Yet another object is a magnetic utility or trouble lamp having a consistent direction of magnetization, avoiding "bucking" of adjacent magnetic fields. Yet another object is a magnetic utility or trouble lamp having a predetermined pattern of magnetization directions. Another object is a utility or trouble lamp having improved versatility with respect to orientation of its illumination. Another object is a utility or trouble lamp with a reflector that is easily reoriented to direct light in a desired direction. Another object is a utility or trouble lamp whose design is readily adaptable to incorporation of common household incandescent lamp bulbs, fluorescent lamp bulbs, and high-intensity lamp bulbs. Another object is to provide a convenient high-magnetic-permeability surface with a magnetic utility lamp for mounting the lamp when neither hook support nor magnetic support on existing surfaces is convenient. An important object is a utility or trouble lamp that can be manufactured by low-cost processes. A related object is providing low-cost manufacturing processes for magnetic utility lamps.

SUMMARY OF THE INVENTION

The magnetic utility lamp of this invention has a housing that is polyhedral or prismatic in shape (having a number of flat faces), a handle, and a hook, all of which are magnetized. The magnetization of the combined housing, handle and hook is preferably done in such a way as to make one common magnetic polarity extending along the major axis of the lamp. In another embodiment, an even number of magnetic polarities may be made, alternating in the senses of their magnetic poles. The combination of polyhedral shape and magnetization provides versatile positioning of the lamp. Within the magnetic housing is a unique polyhedral reflector, which is easily re-oriented by the user to direct light from the lamp bulb in a desired direction. The interior surface of the utility lamp housing is adapted to hold the polyhedral reflector adjustably in a number of discrete aiming directions. The magnetic lamp design is adaptable to accommodate standard household lamp bulbs, fluorescent bulbs, and (with a suitable transformer) high-intensity bulbs. An auxiliary mounting plate of ferromagnetic or high-magnetic-permeability material may be provided, removably attached to the utility lamp housing. The removable auxiliary plate is shaped to fit the polyhedral exterior shape of the utility lamp housing, preferably matching the shape of two or more adjacent flat faces of the housing. The auxiliary plate is equipped with straps for attachment to non-magnetic supports.

DETAILED DESCRIPTION OF THE PREFERRED EMBODIMENTS

Figure 1:
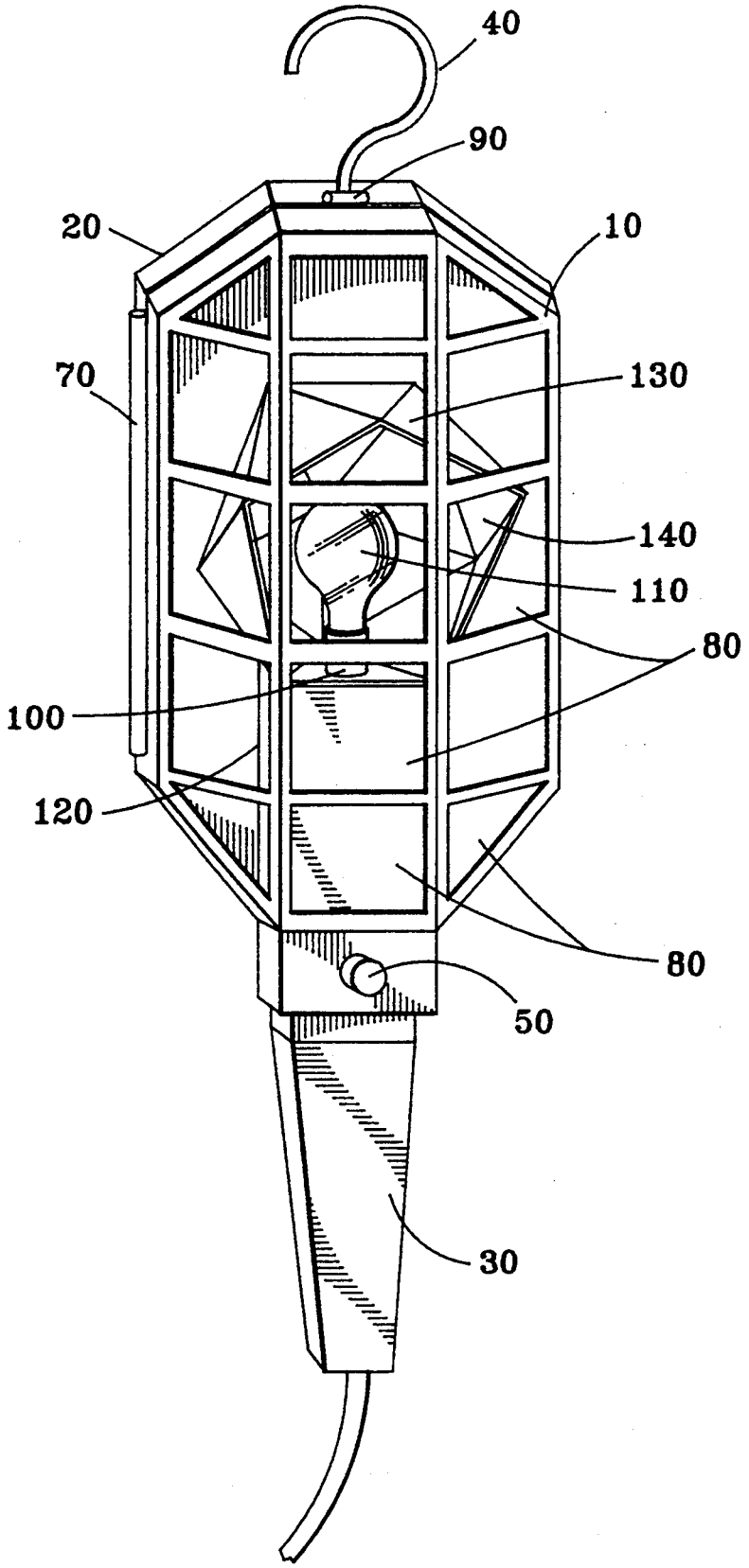
FIG. 1 is a perspective view of a preferred embodiment of a magnetic utility lamp made in accordance with this invention.
Figure 2:
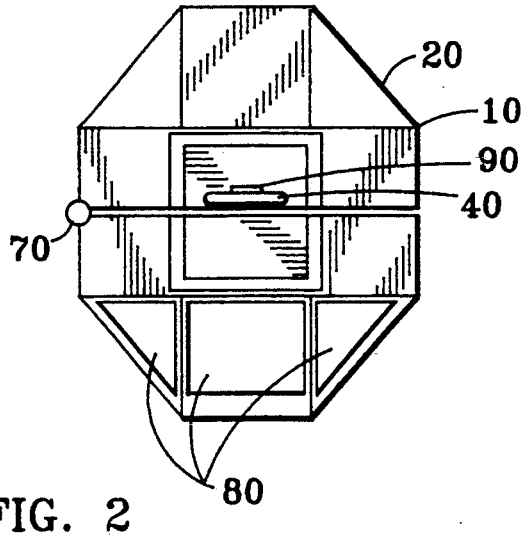
FIG. 2 is a top view of the magnetic utility lamp of FIG. 1.
Figure 3:
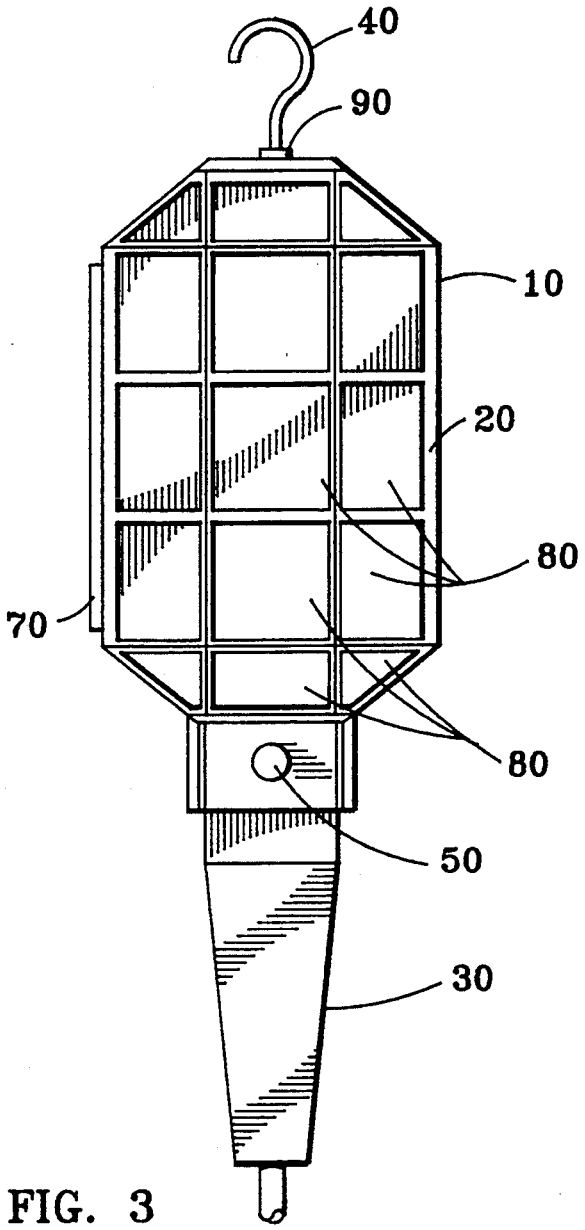
FIG. 3 is a front view of the magnetic utility lamp of FIG. 1.
Figure 4:
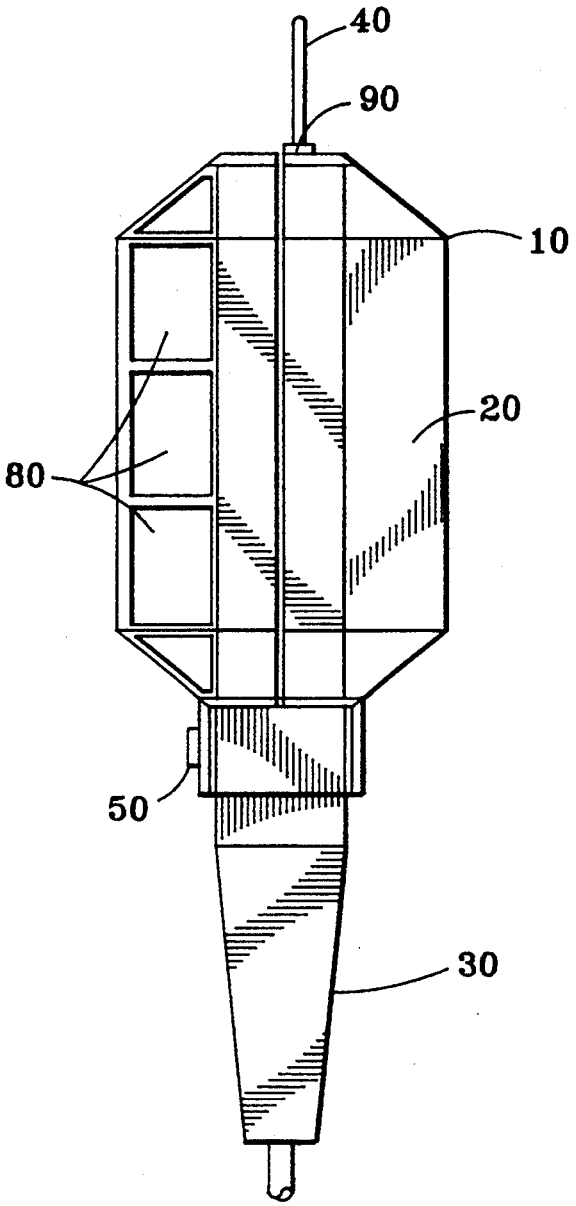
FIG. 4 is a side view of the magnetic utility lamp of FIG. 1.
Figure 5:
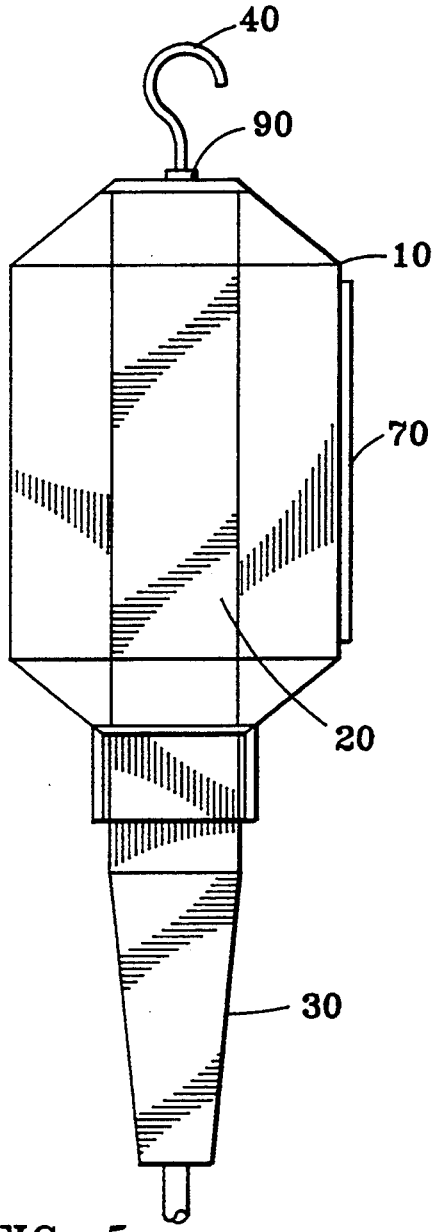
FIG. 5 is a rear view of the magnetic utility lamp of FIG. 1.

FIG. 1 is a perspective view of a preferred embodiment of a magnetic utility lamp 10 made in accordance with this invention. FIGS. 2, 3, 4, and 5 are top, front, side, and rear views respectively of the same embodiment. Lamp 10 has a polyhedral housing 20, a handle 30, and a hook 40. An electric switch 50 is integral with handle 30, and connects to lamp socket 100 holding a lamp bulb 110. A wiring cover 120 provides for centering of lamp bulb 110 in polyhedral housing 20 without exposed wires. Hook 40 is preferably attached to housing 20 by hinge 90, allowing hook 40 to be folded over approximately perpendicular to the main axis of the lamp. Housing 20 may consist of more than one piece, and its pieces may be attached to each other by hinge 70. Polyhedral housing 20 has a number of flat surfaces, some of which have apertures 80 for passage of light from a light bulb 110. In the embodiment of FIG. 1, polyhedral housing 20 has a central portion that is octagonal in cross-section, with truncated pyramidal end portions each having eight side faces. However the improved utility of a magnetic polyhedral housing may be achieved with a number of shapes, including central housing portions that are quadrilateral prisms, rectangular prisms, pentagonal prisms, hexagonal prisms, etc. with pyramidal or truncated pyramidal end portions, or with magnetic housings that have the overall shape of more-or-less regular polyhedra such as dodecahedra or icosahedra.

Within polyhedral housing 20 is a polyhedral reflector 130 substantially surrounding lamp socket 100 and lamp bulb 110 and attaching adjustably to the interior surface of polyhedral housing 20. Polyhedral reflector 130 has an aperture 140 for passage of light outward from lamp bulb 110. Polyhedral housing 130 need not have the same shape, number of faces, etc. as magnetic polyhedral housing 20. In the embodiment of FIG. 1 polyhedral reflector 130 is based on the shape of a regular icosahedron. The interior surface of polyhedral reflector 130 is made reflective. The interior surface of polyhedral housing 20 is adapted to hold polyhedral reflector 130 in a discrete number of orientations.

Magnetic polyhedral housing 20 may be made of a stamped sheet steel material, bent to the desired polyhedral shape, then preferably coated with plastic, and magnetized along with handle 30 and hook 40 after assembly with those parts. If housing 20 is made by this method, tabs of sheet steel may be stamped and bent inward at appropriate angles to hold polyhedral reflector 130, before coating the steel with plastic. In a preferred method of making the utility lamp, plastic or rubber material filled with magnetic particles is injection molded to the final form, and then magnetized. The magnetic particles may be ferrite particles, or particles of magnetic rare-earth compounds for example. The molded form of magnetic housing 20 may include a molded recess in its inner surface to hold polyhedral reflector 130.

In making the magnetic utility lamp, it is beneficial to ensure that the orientations of the magnetic poles of the various faces are aligned, rather than opposing or partially opposing each other, i.e. the north poles of all housing surfaces should be pointing in the same general direction. One way of achieving this alignment is to magnetize the housing, handle and hook after the utility lamp is assembled, but before the lamp bulb is installed. The reason for magnetizing without a lamp bulb installed is to avoid undue mechanical stress on the lamp bulb filament or its mounting conductors due to magnetic forces occurring during magnetization. While many utility lamps are sold without installed bulbs, many appliances using small high-intensity bulbs are sold with bulbs installed. To provide the permanent magnetization aligned as desired, the lamp housing handle and hook are preferably magnetized together by inserting the complete assembly into a magnetizing coil and energizing the coil with electrical current controlled to magnetize the product according to its magnetic hysteresis loop to magnetic saturation. For an alternate magnetization having an even number of magnetized portions alternating in the sense of the their magnetization polarity, it is necessary to provide coils tailored to the particular shape of the housing, with appropriate electrical polarity of those coils to create the desired polarities of magnetic fields. Those magnetic fields are also controlled to magnetize the lamp portions according to their hysteresis loops to reach magnetic saturation.

Figure 6:
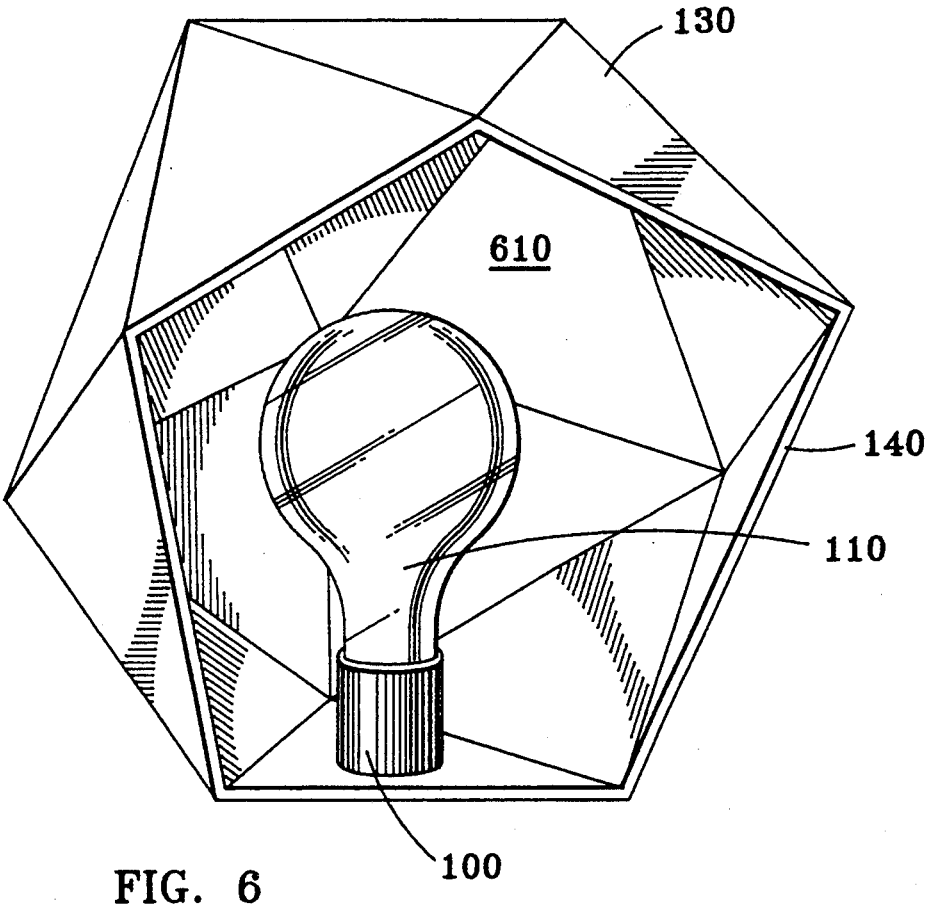
FIG. 6 is a perspective view of one embodiment of a reflector portion of a magnetic utility lamp made in accordance with this invention.

Polyhedral reflectors 130 may be made in a number of polyhedral forms, all having the improved utility of the embodiments shown in this specification. FIG. 6 is a perspective view of one embodiment of a polyhedral reflector 130 of a magnetic utility lamp made in accordance with this invention (the same embodiment as shown in FIG. 1). The polyhedral reflector 130 shown in FIG. 6 is an incomplete icosahedron, lacking five of its twenty sides omitted in order to form aperture 140. The entire interior surface 610 is metallized or otherwise made reflective. Reflector 130 snaps into a mating surface molded on the inside of the rear face of housing 20 as described in more detail below.

Figure 7:
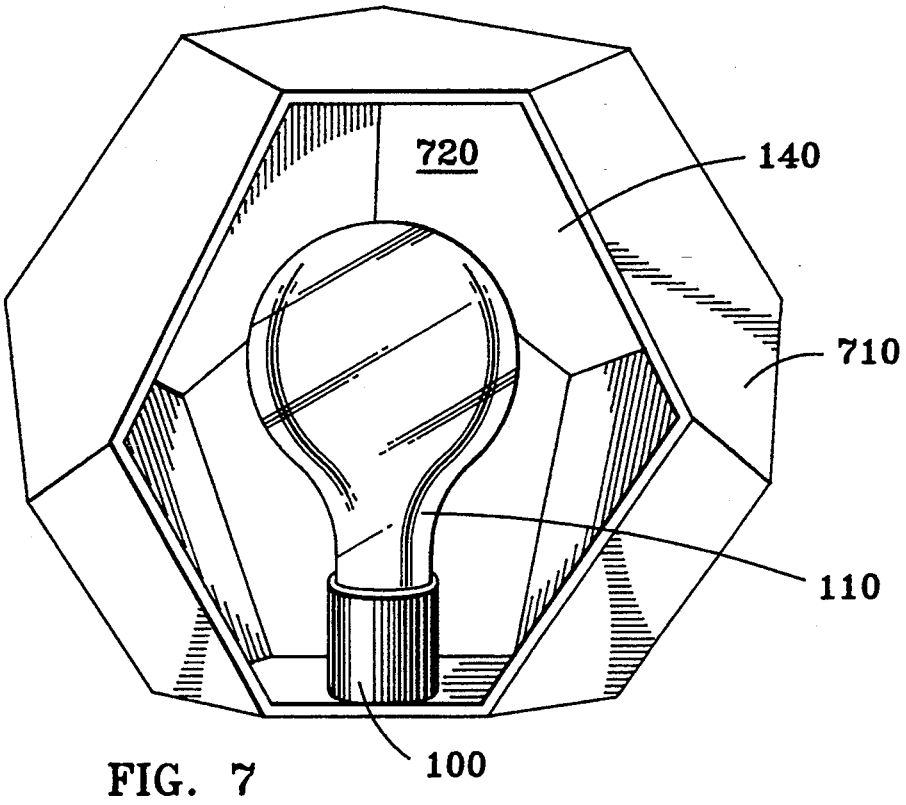
FIG. 7 is a perspective view of a second embodiment of a reflector portion of a magnetic utility lamp.

FIG. 7 is a perspective view of a second embodiment of a polyhedral reflector portion 710 of a magnetic utility lamp. Polyhedral reflector 710 is functionally equivalent to polyhedral reflector 130 of FIG. 1 and FIG. 6. The polyhedral reflector 710 shown in FIG. 7 is a truncated dodecahedron, lacking one of its twelve sides and portions of three other sides in order to form aperture 140. The entire interior surface 720 is reflective. The embodiment of FIG. 7 has fewer faces than the embodiment of FIG. 6, and therefore fewer possible different discrete orientations for aiming the light of the magnetic utility lamp. However the number of orientations available is adequate for many uses of utility lamps, and a distinct improvement over conventional utility lamps without the additional degrees of freedom in aiming the light.

Figure 8A:
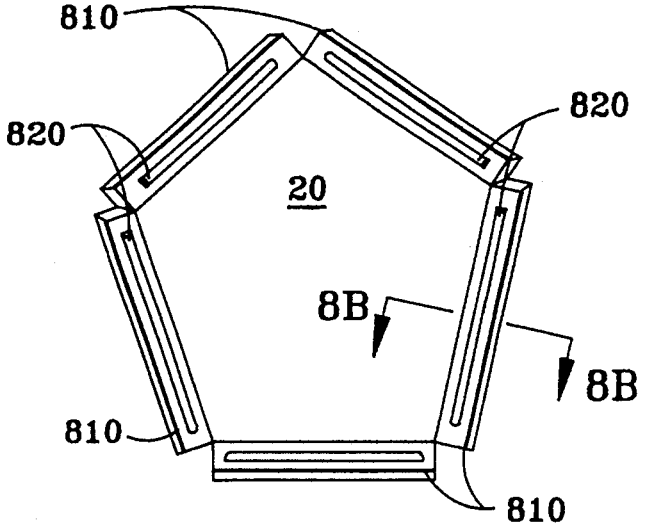
FIG. 8A is a perspective view of a portion of a housing adapted to hold the reflector portion shown in FIG. 7.
Figure 8B:
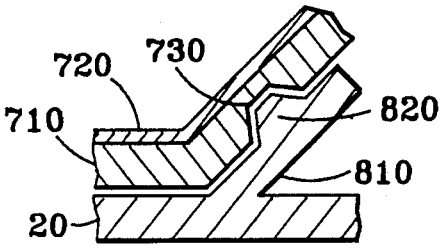
FIG. 8B is a partially cutaway side view of the portion shown in FIG. 8A.
Figure 8C:
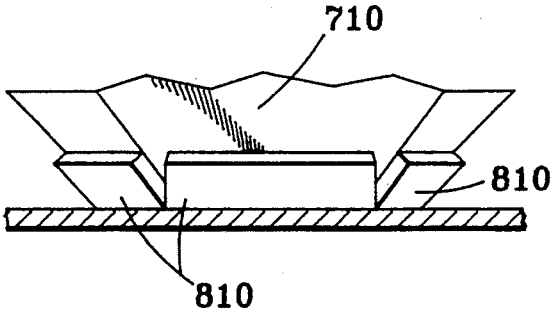
FIG. 8C is a cross-section detail view of the housing portion of FIG. 8A.

FIG. 8A is a perspective view of a portion of housing 20 adapted to hold the polyhedral reflector 710 shown in FIG. 7. Tabs 810 protrude from the interior surface of housing 20 to hold polyhedral reflector 710 in an area corresponding to one of the pentagonal faces of the regular dodecahedron, surrounded by tabs 810. Tabs 810 are made sufficiently thin to be flexible. Ridges 820 may be molded or stamped in the surface of tabs 810, to engage recesses 730 suitable located on the outer surface of polyhedral reflector 710. FIG. 8B is a partially cutaway side view of the portion shown in FIG. 8A, showing the nesting of polyhedral reflector 710 within the space surrounded by tabs 810. FIG. 8C is a cross-section detail view of a portion of FIG. 8A, showing an example of the engagement of ridge 820 with recess 730. In order to aim the light from the magnetic utility lamp, the user removes polyhedral reflector 710 from its position held by tabs 810, re-orients reflector 710 to cast light in the desired direction, and snaps it into place in the new orientation.

Figure 9A:
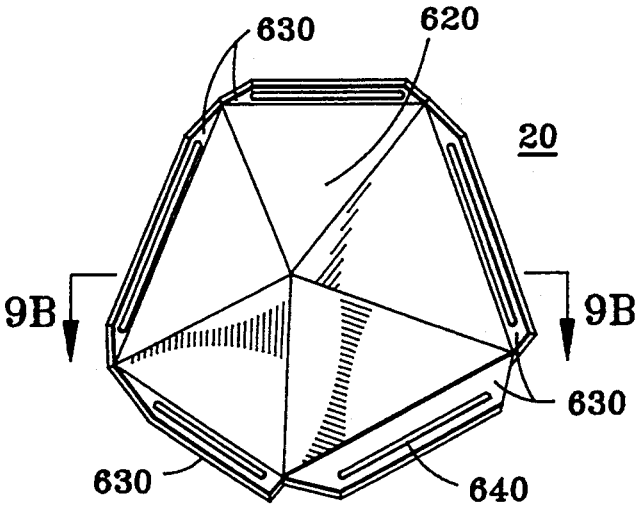
FIG. 9A is a perspective view of a portion of a housing adapted to hold the reflector portion shown in FIG. 6.
Figure 9B:
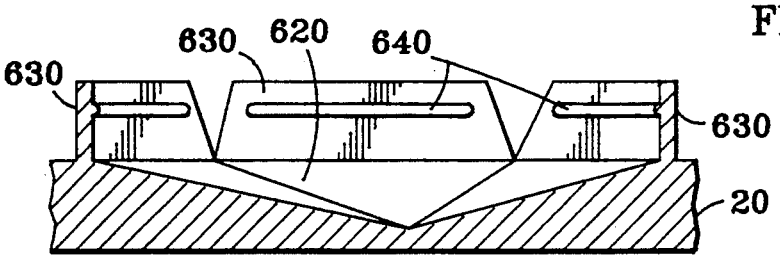
FIG. 9B is a cross-section detail view of the housing portion of FIG. 9A.

FIG. 9A is a perspective view of a portion of housing 20 adapted to held polyhedral reflector 130 shown in FIG. 6, in the same manner as described with reference to FIGS. 8A–8C. Since aperture 140 is not opposite a flat face in this case, housing 20 has a recess 620 molded into its interior surface, to match the convex shape of polyhedral reflector 130. If, in a different embodiment, aperture 140 were placed opposite a flat triangular face of polyhedral reflector 130, recess 620 could be modified or eliminated. FIG. 9B is a cross-section detail view of the housing portion of FIG. 9A. Tabs 630 operate in the same manner as tabs 810 and ridges 640 operate in the same manner as ridges 820. The user re-orients this polyhedral reflector in the same manner as for the embodiment described above.

Figure 10:
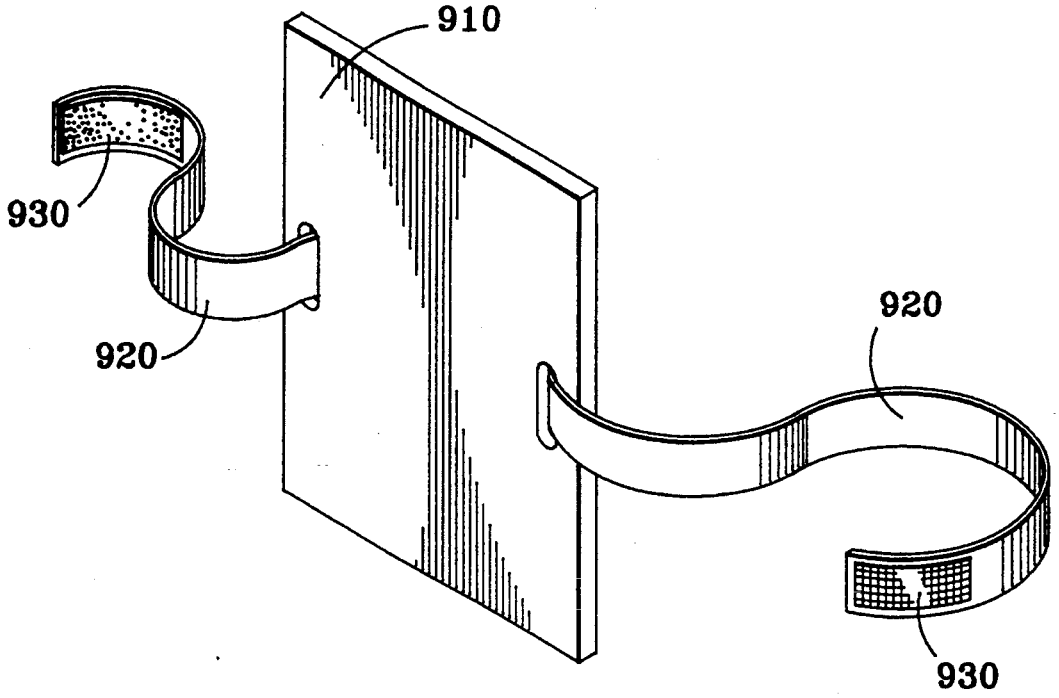
FIG. 10 is a perspective view of one embodiment of an auxiliary mounting plate for a magnetic utility lamp.

Despite the usefulness of a polyhedral magnetic utility lamp in many situations where attachment and/or orientation may not be effective using a hook, there may be other situations where neither a hook nor magnetic attachment is possible. To deal with such situations, an auxiliary mounting plate may be temporarily and removably attached to the magnetic polyhedral utility lamp. The auxiliary mounting plate provides a portable magnetic surface to which the magnetic polyhedral utility lamp is attached magnetically. FIG. 10 is a perspective view of one embodiment of an auxiliary mounting plate for a magnetic utility lamp. This simple embodiment has a flat ferrous-metal plate 910 and a strap 920 with fastening means 930 on the strap, preferably hook-and-loop fastener portions such as Velcro(TM). Strap 920 is used to attach plate 910 to any convenient item in the use environment which may be non-ferrous or diamagnetic. Plate 910 may be made about the same size or slightly smaller than a side face of the central portion of the lamp housing. Plate 910 may be made from sheet steel cut from standard sheet steel stock. The steel may be coated with a plastic coating. Alternatively, plate 910 may be made of rubber or plastic material filled with magnetic particles, such a ferrite particles or particles of a magnetic rare-earth compound.

Figure 11:
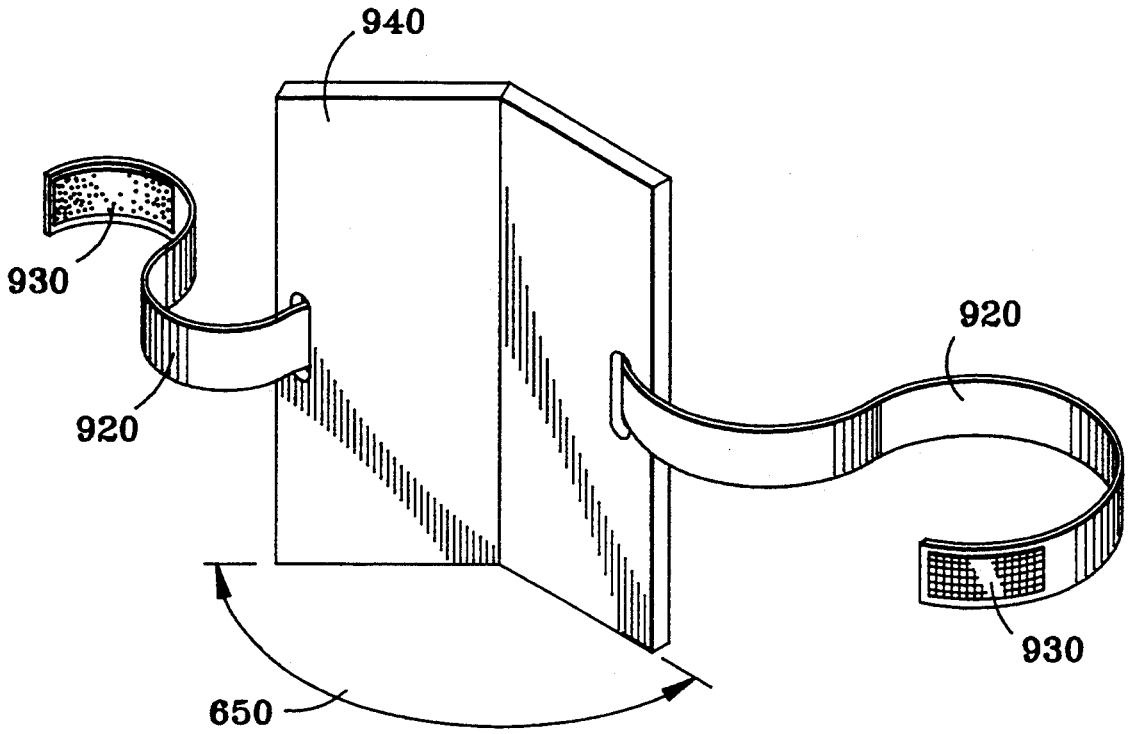
FIG. 11 is a perspective view of a second embodiment of an auxiliary mounting plate for a magnetic utility lamp.

FIG. 11 is a perspective view of a second embodiment of an auxiliary mounting plate for a magnetic utility lamp. This preferred embodiment has a bent ferrous-metal plate 940 which is shaped to fit the exterior surface of magnetic polyhedral housing 20. Concave angle 650 is made to match the convex angle of two adjacent faces of at least the central portion of polyhedral housing 20. For some polyhedral forms of housing 20, the auxiliary mounting plate may have a more complex shape, with a multiplicity of flat surfaces which together match the exterior form of housing 20. The auxiliary mounting plate may also be magnetized in the same manner as the lamp housing, hook, and handle are magnetized.

Figure 12:
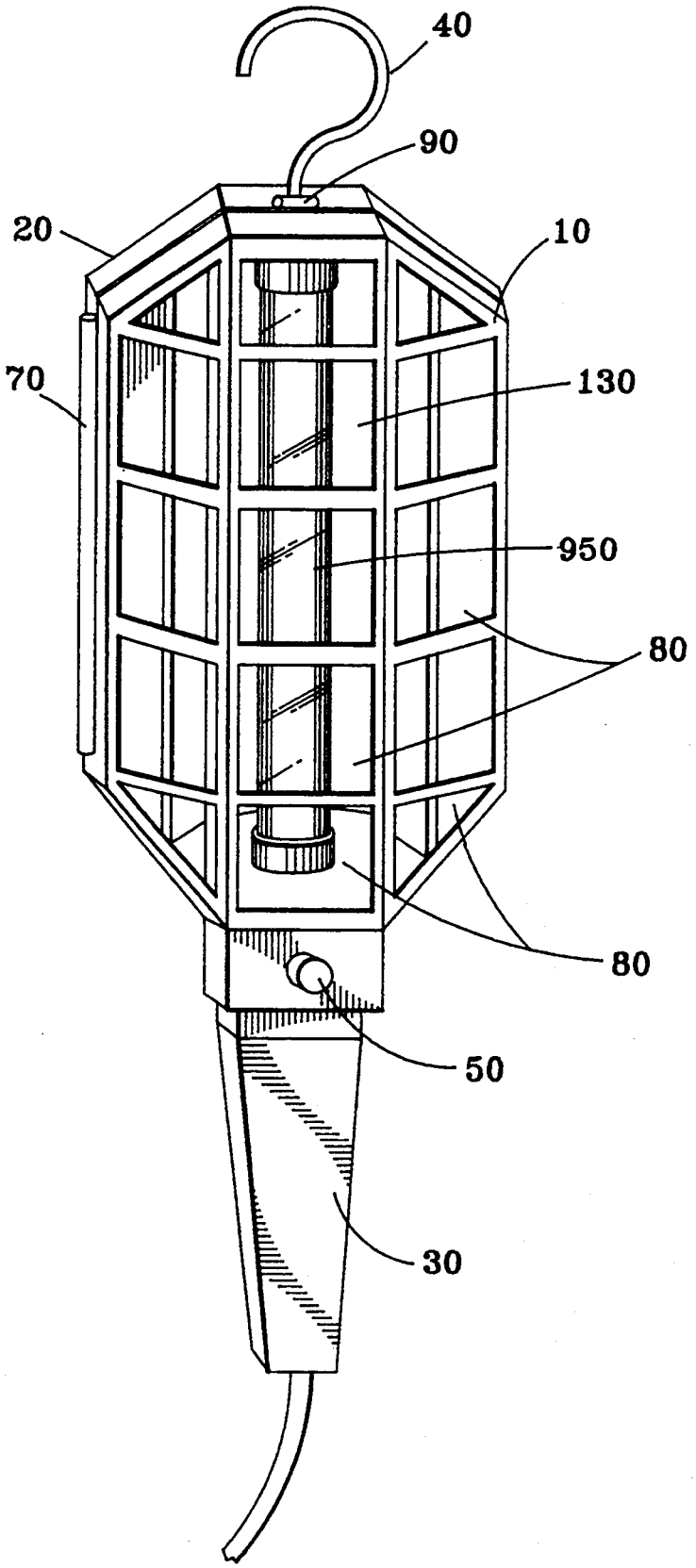
FIG. 12 is a perspective view of another embodiment of a magnetic utility lamp made in accordance with this invention.

FIG. 12 is a perspective view of another embodiment of a magnetic utility lamp, which uses a fluorescent lamp bulb 950. Polyhedral reflector 130 has a number of planar surfaces arranged in a prism shape behind fluorescent lamp 950. Another embodiment uses a small high-intensity lamp in a magnetic polyhedral housing such as that shown in FIG. 1. The high-intensity lamp model uses a small low-voltage transformer, which is preferably connected at the power plug (and/or integral with it) to avoid having the weight of a transformer at the lamp. Other embodiments using DC power connections to the battery of an automobile or other vehicle using heavy-duty alligator clips, clamps, or a cigarette-lighter-type connector.

The magnetic utility lamp is very easy to use, and easier to use than trouble lamps heretofore available. In situations where a suitable, convenient support for the hook is available close enough to the work and properly oriented to direct the light as desired, then of course the magnetic trouble lamp may be used with its conventional hook. In other situations where there is no suitable support for a hook and there is a ferromagnetic surface available, the magnetic feature of the utility lamp is exploited by placing one of the flat surfaces of the lamp housing against the ferromagnetic surface. It will be understood that the references herein to a ferromagnetic surface denote any magnetically suitable surface that will hold the magnetized lamp housing, whether or not it is simply a ferrous metal. If the ferromagnetic surface is not flat or convex, two adjacent flat surfaces are oriented toward the ferromagnetic surface to best fit its shape.

In situations where there is no magnetically suitable surface already available, such a surface may be provided by using the above-mentioned auxiliary mounting plate, fastened in a suitable location to hold the lamp. In that case, the user places the auxiliary mounting plate in appropriate position to hold the lamp, fastens it in place with the hook-and-loop fastening strap if necessary, and then uses the plate to hold the magnetic lamp.

Other embodiments of the invention will be apparent to those skilled in the art from a consideration of this specification or from practice of the invention disclosed herein. For example, the lamp housing may have the same polyhedral shape as the reflector, such as a dodecahedron or icosahedron, so that the housing and reflector are geometrically similar and concentric. The auxiliary mounting plate, if provided, may have compound angles to match more than two faces of the lamp housing. Straps or other attachment means of an auxiliary mounting plate may have fasteners other than hook-and-loop fasteners, such as a buckle and appropriately spaced holes. It is intended that the specification and examples be considered as exemplary only, with the true scope and spirit of the invention being defined by the following claims.

Having described my invention, I claim:

1. A magnetic utility lamp, comprising:

a) a housing having a multiplicity of flat major surfaces, having first and second housing ends, and having a major axis extending between said first and second housing ends, at least one of said flat major surfaces having a housing aperture for passage of light, b) a handle with integral electric switch attached to said first housing end, c) a lamp socket contained within said housing and controlled by said integral electric switch, d) electric wires connected to said integral switch and said lamp socket, passing through said handle and connected to a power connector for connection to a source of electric power, e) a hook attached to said second housing end, said housing, handle, and hook all being fabricated of magnetic material and being magnetized.

2. A magnetic utility lamp as in claim 1, wherein said housing has a central portion and end portions, said central portion further comprises a prism having at least four rectangular sides, and said end portions each further comprise truncated pyramids.

3. A magnetic utility lamp as in claim 2, wherein said central portion comprises an octagonal prism, thereby having eight rectangular sides.

4. A magnetic utility lamp as in claim 3, wherein at least three of said eight rectangular sides have housing apertures therein for passage of light.

5. A magnetic utility lamp as in claim 2, wherein said central portion comprises a hexagonal prism, thereby having six rectangular sides.

6. A magnetic utility lamp as in claim 5, wherein at least two of said six rectangular sides have housing apertures therein for passage of light.

7. A magnetic utility lamp as in claim 2, wherein said central portion comprises a rectangular prism, thereby having four rectangular sides.

8. A magnetic utility lamp as in claim 7, wherein at least one of said four rectangular sides has a housing aperture therein for passage of light.

9. A magnetic utility lamp as in claim 1, wherein said housing further comprises a polyhedral having at least nine faces, at least one of said faces having a housing aperture therein for passage of light.

10. A magnetic utility lamp as in claim 1, wherein said hook attached to said housing is attached by a hinge.

11. A magnetic utility lamp as in claim 1, wherein said lamp socket is of a type to accept a standard household lamp bulb.

12. A magnetic utility lamp as in claim 1, wherein said lamp socket is of a type to accept a fluorescent lamp bulb.

13. A magnetic utility lamp as in claim 1, wherein said lamp socket is of a type to accept a high-intensity lamp bulb, and said utility lamp further comprises a transformer electrically connected to said electric wires and said lamp socket through said integral switch in series to power said high-intensity lamp bulb.

14. A magnetic utility lamp as in claim 1, wherein said housing, handle, and hook are magnetized with a single magnetic polarity substantially parallel to said major axis of said housing.

15. A magnetic utility lamp as in claim 1, wherein said housing and handle are magnetized with an even number of magnetic polarities, and adjacent polarities alternate in magnetic sense.

16. A magnetic utility lamp as in claim 15, wherein said magnetic polarities are oriented substantially parallel to said major axis.

17. A magnetic utility lamp as in claim 1, wherein said housing has an interior surface, and said interior surface is reflective to reflect light from a lamp bulb outward through said housing aperture.

18. A magnetic utility lamp as in claim 1, further comprising a polyhedral reflector contained within said housing and enclosing said lamp socket, said polyhedral reflector having interior and exterior surfaces, at least one reflector aperture for passage of light, and said interior surfaces of said reflector having reflective surfaces to reflect light from a lamp bulb outward through said reflector aperture.

19. A magnetic utility lamp as in claim 18, wherein said polyhedral reflector has n sides, where n is an integer in the range from 4 to 20.

20. A magnetic utility lamp as in claim 18, wherein said polyhedral reflector comprises a dodecahedron.

21. A magnetic utility lamp as in claim 18, wherein said polyhedral reflector comprises an icosahedron.

22. A magnetic utility lamp as in claim 18, wherein said polyhedral reflector is adjustable to aim light passing through said reflector aperture in a chosen direction.

23. A magnetic utility lamp as in claim 18, wherein said housing has an interior surface, and said interior surface further comprises means for releasably holding said polyhedral reflector.

24. A magnetic utility lamp as in claim 23, wherein said means for releasably holding said polyhedral reflector comprise tabs conformable to at least a portion of said exterior surface of said polyhedral reflector.

25. A magnetic utility lamp as in claim 24, wherein said exterior surface of said polyhedral reflector has recesses disposed to releasably engage said tabs, whereby said polyhedral reflector is adjustable to aim light passing through said reflector aperture in a chosen direction.

26. A magnetic utility lamp as in claim 24, wherein said tabs are molded integrally with said interior surface of said housing.

27. A magnetic utility lamp as in claim 23, wherein said interior surface of said housing has a recess shaped to fit said exterior surface of said polyhedral reflector.

28. A magnetic utility lamp as in claim 1, wherein said magnetic material comprises steel.

29. A magnetic utility lamp as in claim 1, wherein said housing has an outer surface, further comprising a plastic coating substantially covering said outer surface of said housing and substantially covering said handle.

30. A magnetic utility lamp as in claim 28, wherein said housing has an outer surface, further comprising a plastic coating substantially covering said outer surface of said housing and substantially covering said handle.

31. A magnetic utility lamp as in claim 1, wherein said magnetic material further comprises a plastic containing magnetic particles.

32. A magnetic utility lamp as in claim 31, wherein said magnetic particles further comprise ferrite particles.

33. A magnetic utility lamp as in claim 31, wherein said magnetic particles further comprise rare-earth compound particles.

34. A magnetic utility lamp as in claim 29, wherein said plastic coating further comprises a plastic containing magnetic particles.

35. A magnetic utility lamp as in claim 34, wherein said magnetic particles further comprise ferrite particles.

36. A magnetic utility lamp as in claim 34, wherein said magnetic particles further comprise rare-earth compound particles.

37. A magnetic utility lamp as in claim 1 further comprising an auxiliary plate removably attached to said housing for attaching the lamp to non-magnetic objects, said auxiliary plate further comprising a plate of ferromagnetic material and strap attachment means.

38. A magnetic utility lamp as in claim 37, wherein said auxiliary plate is flat.

39. A magnetic utility lamp as in claim 37, wherein said housing has a polyhedral exterior surface, and wherein said auxiliary plate is shaped to match a portion of the polyhedral exterior surface of said housing.

40. A magnetic utility lamp as in claim 39, wherein said housing has a polyhedral exterior surface having at least two adjacent faces, and said auxiliary plate has a single bend at an angle to match that portion of said polyhedral exterior surface of said housing consisting of said two adjacent faces.

41. A magnetic utility lamp as in claim 37, wherein said strap attachment means further comprises one or more straps having first and second ends and having hook-and-loop fasteners extending along at least a portion of said straps adjacent to said first and second ends.

42. A magnetic utility lamp as in claim 37, wherein said strap attachment means further comprises one or more straps having first and second ends and having a buckle attached to said first end of said straps.

43. A magnetic utility lamp as in claim 37, wherein said auxiliary plate further comprises a steel plate.

44. A magnetic utility lamp as in claim 43, wherein said auxiliary plate further comprises a plastic coating covering at least a selected portion of said steel plate.

45. A magnetic utility lamp as in claim 37, wherein said auxiliary plate further comprises a plastic material filled with ferromagnetic particles.

46. A magnetic utility lamp, comprising in combination:

a) a polyhedral housing having a multiplicity of flat major exterior faces, having a housing interior surface, having first and second housing ends, and having a major axis extending between said first and second housing ends, at least one of said flat major exterior faces having a housing aperture for passage of light, and said housing interior surface comprising a multiplicity of planar surfaces forming a concave polyhedral recess, b) a handle with integral electric switch attached to said first housing end, c) a lamp socket contained within said housing and controlled by said integral electric switch, d) a polyhedral reflector substantially surrounding said lamp socket, said polyhedral reflector having a reflector aperture for passage of light, an interior reflector surface and an exterior reflector surface, said interior reflector surface being reflective, and said exterior reflector surface comprising a multiplicity of planar surfaces, a portion of said exterior reflector surface fitting said concave polyhedral recess in said housing interior surface, e) electric wires connected to said integral switch and said lamp socket, passing through said handle and connected to a power connector for connection to a source of electric power, f) a hook hingedly attached to said second housing end, said polyhedral reflector being adjustably attached to said housing for aiming of light in a desire direction, and said housing, handle, and hook all being fabricated of magnetic material and being magnetized.

47. A magnetic utility lamp as in claim 46, further comprising an auxiliary plate removably attached to said housing, said auxiliary plate further comprising a plate of ferro-magnetic material shaped to fit at least one of said exterior major surfaces of said polyhedral housing, and at least one strap for attaching the lamp to non-magnetic objects.

* * * * *